US007631704B2

(12) United States Patent
Hagemeyer et al.

(10) Patent No.: US 7,631,704 B2
(45) Date of Patent: Dec. 15, 2009

(54) DRILL FRAME WITH TOOL MAGAZINE

(75) Inventors: Carl Hagemeyer, Olpe (DE); Thomas Wurm, Wenden/Gerlingen (DE); Albert Clemens, Wenden (DE)

(73) Assignee: Kleum Bohrtechnik Zweigniederlassung der Bauer Maschinen GmbH, Drolshagen (DE)

( * ) Notice: Subject to any disclaimer, the term of this patent is extended or adjusted under 35 U.S.C. 154(b) by 178 days.

(21) Appl. No.: 11/353,278

(22) Filed: Feb. 15, 2006

(65) Prior Publication Data

US 2006/0162963 A1 Jul. 27, 2006

(30) Foreign Application Priority Data

Sep. 18, 2004 (DE) ..... 10 2004 045 404

(51) Int. Cl.
*E21B 19/00* (2006.01)

(52) U.S. Cl. ..... 175/52; 175/85; 166/379; 166/380; 166/77.51

(58) Field of Classification Search ..... 175/52, 175/85; 166/344, 379, 380, 77.1, 77.51, 166/414

See application file for complete search history.

(56) References Cited

U.S. PATENT DOCUMENTS 3,301,337 A * 1/1967 Vaughn et al. ..... 175/22
4,258,796 A 3/1981 Horning et al.
5,215,153 A 6/1993 Younes
5,746,279 A * 5/1998 Havlinek et al. ..... 175/52
6,085,852 A * 7/2000 Sparks et al. ..... 175/52
6,766,860 B2 * 7/2004 Archibald et al. ..... 166/341
2002/0117335 A1 * 8/2002 Koch et al. ..... 175/52

FOREIGN PATENT DOCUMENTS

DE 19810707 9/1999
EP 0379187 7/1990

* cited by examiner

*Primary Examiner*—David J Bagnell
*Assistant Examiner*—Sean D Andrish
(74) *Attorney, Agent, or Firm*—James Creighton Wray; Meera P. Narasimhan

(57) ABSTRACT

A drill frame or drill platform 1 is allocated to a ship caisson 6 in order to allow bore holes 12, 13 to be driven, for example, into the bottom of a lake 11. Since said bore holes 12, 13 must subsequently be filled with explosives, the use of several drill tools 25 of different design is necessary and possible because a rod magazine 20 comprising several different drill tools 25 is allocated to said drill frame 1. It enables simple and rapid replacement because a conventional clamping device 29 and clamping and crushing device 30 can be employed. The individual drill tools 25 are each equipped with adapters 31 of identical design so that they can be seized and actuated safely using the described clamping and drilling (sic) devices 29, 30.

21 Claims, 9 Drawing Sheets

Figure 1:
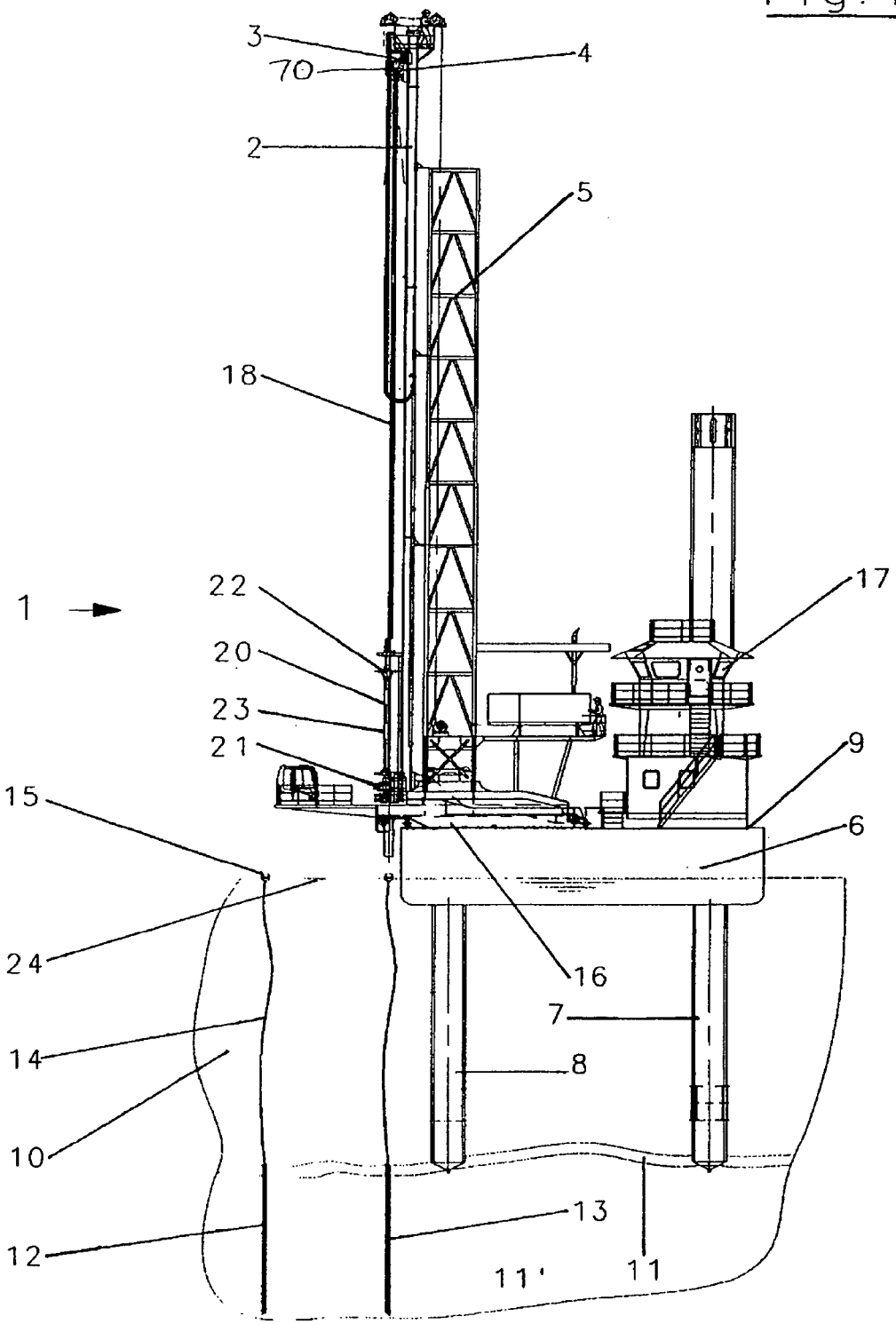

Fig. 3
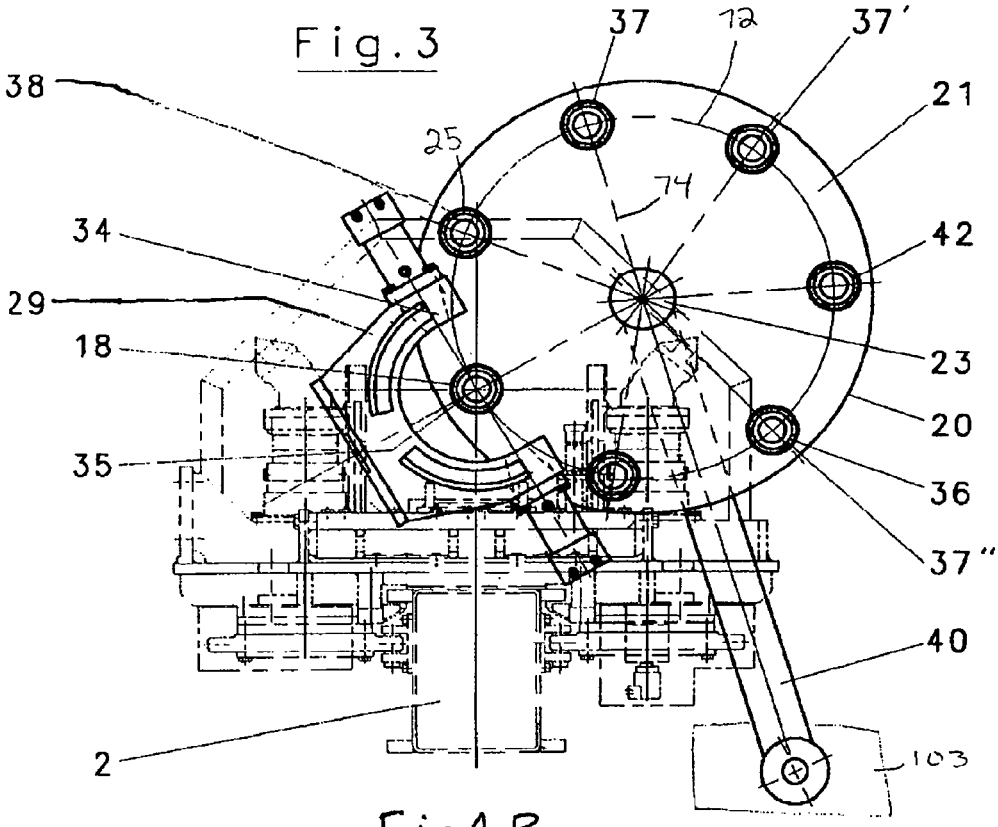
Fig4A
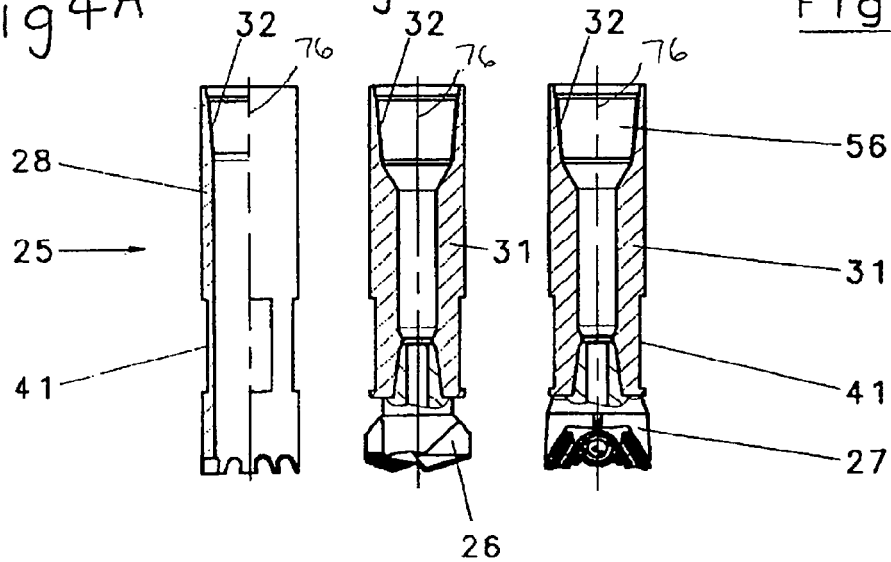
Fig4B
Fig. 4C 18
21
25
29
30
31
35
50
51
56
57
78
82
84
86
98

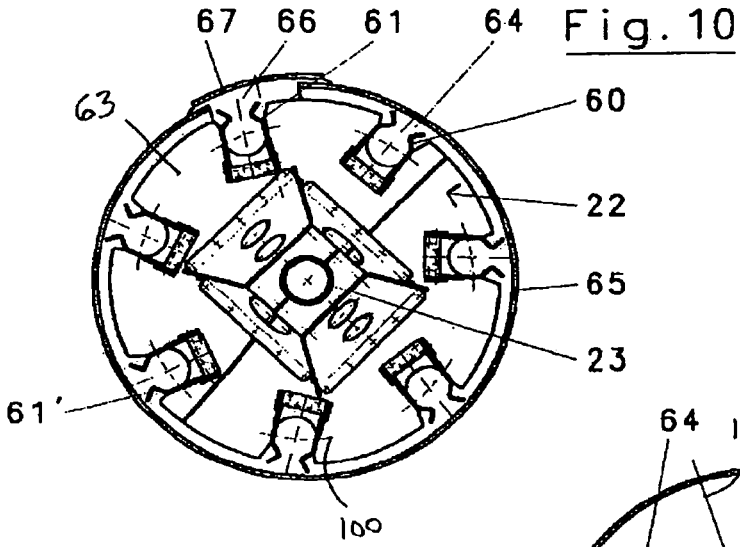
Fig. 10
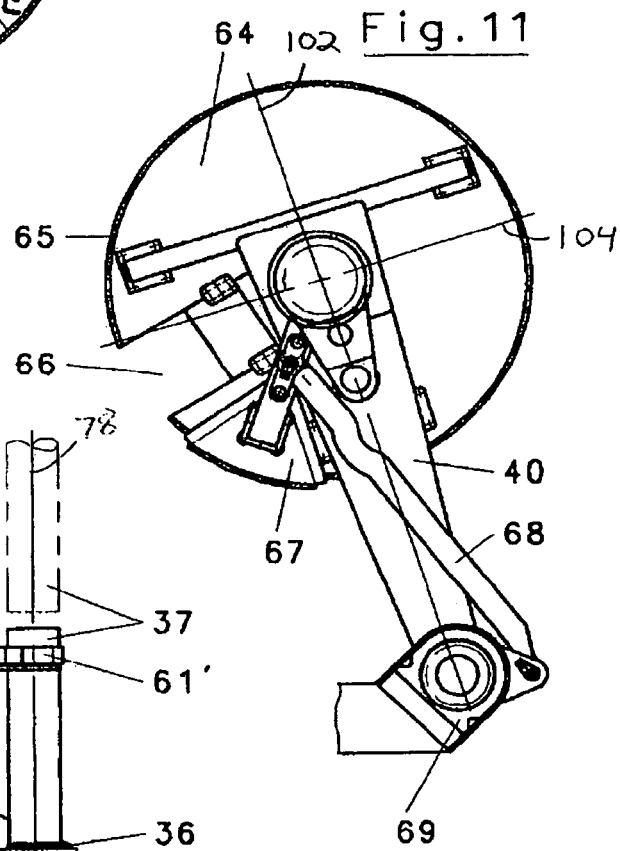
Fig. 11
Fig. 12
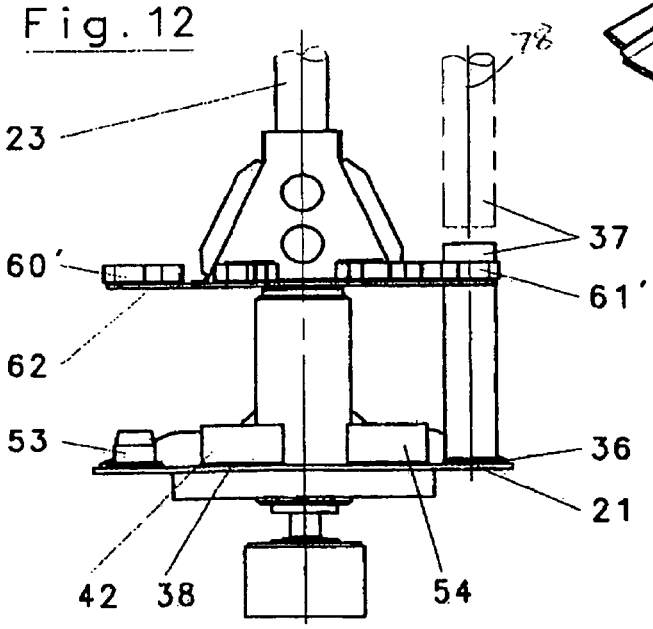

DRILL FRAME WITH TOOL MAGAZINE

This application claims the benefit of German Application No. 10 2004 045 404.3 filed Sep. 18, 2004, which is hereby incorporated by reference in its entirety.

BACKGROUND OF THE INVENTION

The invention relates to a drill frame for driving bores for different or alternating functions with a rig that accommodates a carriage for the sliding drill head, the drill hammer or other drill instrument arranged thereon with a rotating gear and with a drill tool detachably connected to the drill instrument in the form of a bit, a roller bit or a ring cutter, and with a clamping and crushing device for the drill rod arrangement.

Bores are driven into mountains or into the ground for various reasons. It is known, for example, to drive wells for crude oil or natural gas using roller bits, to perform core borings using ring cutters, and to use 3-winged cutters or bits where they are required due to the hardness of the rock. It is also known to drive bores for example with bits in order to then add explosives and extract the crushed rock with suitable devices once the blasts have been performed. Such blast bores are used when driving tunnels and when driving sections in underground mining, but also in places where ores or minerals are extracted in open pit mining. It is further known to use rod magazines in which individual drill rods are held, which are taken out of the rod magazine, swiveled into the bore axis and then connected to the remaining drill rod arrangement so as to be able to drill gradually further into the rock. Here of course, the rod magazines also serve the purpose of detaching the individual drill rods when the rod arrangement is being pulled, and then storing them again for the interim. Connecting and detaching the individual drill rods is accomplished by means of familiar clamping and crushing devices. Inserting the explosive after the bore has been driven is especially difficult in bodies of water because it must be ensured that the individual packages or bundles of explosives are in fact deposited in the very bottom of the bore. After driving the bore with the roller bit or the bit, a ring cutter should be used to create the prerequisites for enabling the packages of explosives to be flushed down to the very bottom of the bore hole. Therefore in the case of such bores, bits, roller bits, and ring cutters need to be kept available and be connected to the drill rod arrangement as needed. To do so manually requires much effort and is difficult even when utilizing crane systems or the like, especially since the connection and detachment in the frame of the clamping and crushing device requires exact positioning of the individual parts.

SUMMARY OF THE INVENTION

It is therefore the object of the invention to create a drill frame that will enable the driving of bore holes having different functions, while requiring little set-up time and little labor.

The object is achieved pursuant to the invention in that the bit or 3-winged cutter, the roller bit or the ring cutter or other drill tool is equipped with an attachment or adapter, which comprises a thread corresponding to the thread of the drill rod arrangement and is designed such that it can be seized by the clamping and crushing device, and in that a rod magazine that is pivotable in the bore axis and has platforms for the drill tools or a device for swiveling the individual drill rods/drill tools is allocated to the rig.

Due to the special design first of the adapters that are allocated to the drill tools and second of the allocated drill rods, and due to the special design of a rod magazine, it is possible to insert the drill tools, which are problematic in terms of their weight and handling, easily and safely as needed in the drill axis, and to connect them there to the drill rod arrangement and/or the drill rods. It is likewise feasible to detach the drill tool that forms the front end of the drill string from the drill rod arrangement with the aid of the clamping and crushing device, to transfer it to the drill rod magazine, and to insert a different drill tool in the drill axis, preferably by means of pivoting, so that it can now be connected to the drill string and be used. Advantageously, the same drill rod arrangement and the allocated equipment are always used, enabling not only a quick change of the respective drill tool, but also fully efficient operation because the correct tool for the respectively planned function is available at all times and can be brought into the drill position or be replaced quickly and safely. Thus it is possible for the first time to install exploratory bores with a ring cutter as well as a bore in a more or less hard area with hard rock with the roller bit or with the bit in the hard rock, and/or after producing the bore, for example by means of the roller bit, to create a situation with the aid of the ring cutter that will enable the passing or flushing of the blasting cartridges into the bore hole using one and the same drill device, and in the end also the same drill string. At the same time it offers the possibility of subsequently placing the fuse in a position that will make detection easy as well as connection to other fuses, so that a variety of such blast bores can then be performed one after the other.

Pursuant to one expedient further development of the invention it is provided that the rig is designed such that it can accommodate and guide a drill rod arrangement consisting of several drill rods connected to each other. While this is associated with a corresponding higher or longer rig, it enables a long drill path, for example of 20 meters or more. In this way it is possible to drive a bore when the body of water deepens, for example, using only a single drill string without the need for extensions.

Further above it was explained that the individual drill tools are held in a rod magazine, which apart from the drill tools accordingly also holds individual replacement drill rods. This rod magazine is supposed to pivot with the respectively provided tool or also the drill rod in the drill axis, which pursuant to the invention is possible easily and safely because the rod magazine is arranged pivotably on the rig at the height of the clamping and crushing device by means of a swivel arm. In this manner it is possible to transfer the rod magazine around the rig in the respective working position, e.g. in the drill axis, so that the respective drill tool or the replacement drill rod can be removed and be connected to the drill rods, or vice versa.

In order to be able to pivot the provided drill tool or the replacement drill rod in the drill axis, it is necessary to move the respective location of said component in the drill axis, which pursuant to the invention is possible without difficulty since the rod magazine is designed such that it can rotate around a center line and comprises a lower rotary table containing the platforms with holders for the drill tools and/or for replacement drill rods serving as platforms. The respective holder with the drill tool or the replacement drill rod arranged therein is hence initially rotated into the desired working position, whereupon the entire rod magazine is pivoted such that the desired component is then located in the drill axis.

Apart from the platforms, or more specifically the holders, on the lower rotary table, the replacement drill rods should expediently also be guided at the upper end, which is enabled by the fact that the upper rotary table of the rod magazine is equipped with elastic clamps for the drill rods. The respective replacement drill rod is pushed into the allocated clamp, which then closes so that the drill rod is seated securely even at the upper end.

The respective drill rods are equipped with gripping surfaces, which the grippers of the clamping and crushing device can seize in order to prevent said drill rods from spinning. Pursuant to the invention it is provided that the drill tools and/or their adapters are also equipped with gripping surfaces for the grippers of the clamping and crushing device, thus providing the possibility of working with known clamping and crushing devices to either connect the drill tools to the drill string or detach them from it.

In order to ensure that the ends of the drill string, i.e. of the respective drill rod, as well as the adapters can be gripped and seized with the grippers of the clamping and crushing device, the invention provides for the gripping surfaces on the adapter and on the drill rods to be incorporated on the adapter and/or the respective drill rod taking into account the distance of the clamping device and the clamping and crushing device. This requires particular consideration of the gripping surfaces also on the drill rods since the adapters are significantly shorter than the drill rods. However, with the appropriate dimensioning of the gripping surfaces on the drill rods as well it is possible, as mentioned, to work with known clamping devices and clamping and crushing devices.

A secure insertion of the drill string and also of the drill tools into the respective clamping and crushing device is guaranteed because hydraulic drill rod guides, serving above all as drilling guides, are allocated to the clamping device and the clamping and crushing device. In particular the device that faces the clamping and crushing device, i.e. the lower, of the bore hole is allocated such a drill rod arrangement guide in order to ensure a secure start of the drilling process and a secure through-drilling.

A simple lowering of the drill tools into the rod magazine, following the specifications precisely, is possible because the holders for the drill tools and also for the replacement rods are designed to be pot-like or stud-like and are placed on top of the lower rotary table. While it is then necessary to raise the drill tool or the drill rod slightly before pivoting it in the drill axis, this can be accomplished without difficulty using the existing grippers or clamping jaws. Due to the pot-shaped design, however, it is also ensured that it stands up securely. Further below it is also explained how the drill tools and also the drill rods or replacement drill rods can be seated in the rod magazine in an even more optimal fashion.

In the embodiment of the invention described further above, the lower rotary table is designed to be circular, wherein the replacement drill rods, above all the drill tools, are arranged on the outer collar. It is, however, also feasible—especially when more replacement drill rods are required—to design the lower rotary table such that it comprises one or more additional tables that rotate separately from the rotary table and accommodate the drill tools, to which the holders for the drill tools, preferably for the bit, roller bit or ring collar, are allocated, wherein the actual rotary table comprises further holds for replacement drill rods. In this manner it is possible to arrange three drill tools in one location, resulting in a significantly larger number of platforms for the replacement drill rods. Of course it is also possible to use several such additional tables, however according to present experience generally one such allocation of an additional table is sufficient.

During the final detachment of the connection between the drill tool and the drill rod or also when individual drill rod connections are being detached, any accidental initiation or performance of a crushing operation with the rotating gear is prevented, in that the rotating gear of the drill instrument for detaching the already disassembled drill rod-drill tool connection is set to a safety mode. The torque in the direction of detachment is then adjusted such that it is just sufficient to unscrew a threaded connection with the clamping and crushing device that has already been interrupted. Crushing is hence safely excluded with a rotating gear.

Another embodiment of the invention provides that the rig is allocated to a ship caisson or a stabilizing ship and comprises deck guides, which are designed such that they enable a position change in several directions. Especially when a variety of bores are supposed to be driven across a large surface comprehensively, for example as the body of water gets deeper, this embodiment allows a plurality of bores to be driven simultaneously, or better successively, from one location of the ship caisson or the ship so as to then move the ship caisson and fasten it in a new position and drive new bores.

As was mentioned further above, the drill tools are seated in appropriate pot-shaped holders. Especially in the case of a rough drilling operation it is beneficial if also on the upper end additional securing is provided. For this purpose the invention provides that the clamps for the adapters above the holders are allocated to a center table arranged on the center line. In this manner, similar to the replacement drill rods, an upper and lower "fixation" of the drill tools is ensured, wherein the adapters have the shape of the drill rods anyhow and hence can be fastened using the same clamps as the corresponding replacement drill rods.

The individual drill tools can be set up mixed among each other because they have the same design with respect to their lengths and also the adapter shape. Accordingly it is provided that the adapters together with the corresponding drill tool are designed to always have the same length and accordingly also always have the gripping surfaces in the same location. At the same time, replacement drill tools can also be arranged quickly in this manner because they always fit in the provided holders and clamps.

Both with respect to the fixation of the drill tools on the center table and to the replacement drill rods on the upper rotary table it is provided that the clamps are adjustable and are preferably correspondingly connected to the base plate of the top rotary table or the center table. In this way they can be adjusted in terms of their retaining action or spring action such that they safely fulfill their function even after frequent use.

The replacement drill rods, which are significantly longer than the drill tools, are held on the upper rotary table by means of clamps, wherein an unintentional falling out of the rod magazine is additionally prevented in that the upper rotary table comprises a support edge plate with a support edge protruding in the direction of the lower rotary table. In the case of an inaccurate arrangement of a replacement drill rod, if it were to slide out of the clamp, it would be safely caught by the support edge and thus damage to the drill device or even an impairment of the employees would be safely avoided.

In order to be able also to remove the replacement drill rods from the rod magazine without difficulty, the invention provides for the stationary arrangement of the support edge plate and a lateral recess in the support edge, which can be closed by means of a segmental slide in the stored state of the rod magazine, which can pivot together with the rod magazine by means of a fly lever. When the rod magazine is pivoted into the drill axis, the segmental slide is simultaneously opened such that now the provided replacement drill rod can be removed without hitting the support edge and thus impairing the upper rotary place or the support edge plate.

Apart from the circular design of the rod magazine pursuant to the variation described above, however, it is also conceivable for the rod magazine to have a rectangular design and comprise several rod shafts that accommodate drill tools and/or drill rods, wherein the entire rod magazine or the individual drill tools or drill rods can pivot in the drill axis by means of familiar grippers. While in such an embodiment a corresponding gripper is required, or better two such grippers are required, it may be beneficial depending upon the design to use such a rectangular and hence compact rod magazine.

Should it not be necessary to keep the replacement drill rods available, the rod magazine can also have a significantly smaller and more compact design, in which the rod magazine is designed to accommodate only drill tools and for this purpose consists of the lower rotary table and the center table and the center axis that connects them. This very short rod magazine can also be kept very small in size in terms of the circumference of the tables due to the e.g. three or four drill tools.

Another possibility is to utilize the present invention in cases where it is not absolutely necessary to keep several different drill tools available, wherein the invention is also implemented when the rod magazine is designed only to accommodate replacement roller bits or only replacement bits or only replacement ring cutters, preferably with an allocated adapter. These smaller, compact rod magazines make it possible to considerably reduce the time needed for replacement since by nature also roller bits, bits and ring cutters wear out and then need replacing. The times required for this are shortened considerably if a correspondingly designed rod magazine, as described above, is employed. Of course it is also possible to provide the drill tool spots in a rod magazine, which e.g. when driving deep bores always keeps the drill rods that are required for the extension of the drill string available. One of the drill rods' spots is then used for the replacement roller bits, bits or ring cutters, which are allocated to a correspondingly small additional table, which as such is again designed to rotate in order to pivot the respectively required drill tool into the working position.

The invention is especially characterized in that a drill frame is created, which is expanded by a rod magazine, the lower rotary table of which is allocated holders or platforms for different or also equivalent drill tools. Said drill tools in the form of a bit, a roller bit or a ring cutter or also in a different form can then be removed from said rod magazine, wherein conventional clamping devices and/or clamping and crushing devices may be used. The rod magazine itself can rotate so that the respectively desired version of the drill tool is pivoted into the working position, i.e. in the drill axis, so as to then be connected to the rod or later be detached therefrom. The respective set-up times, or better change-over times, are hence shortened considerably, made significantly safer because the human hand no longer is involved and beyond that it also offers the possibility of having these different drill tools in hand for a short time if necessary. Furthermore, the possibility of provided of having the individual drill tools with equivalent replacement drill tools available in the rod magazine so that in the case of necessary replacements these can be performed with the same advantage as described above.

Further details and advantages of the invention result from the following description of the appropriate drawings, which illustrate a preferred exemplary embodiment with the necessary details and individual components. Shown are:

BRIEF DECRIPTION OF THE DRAWINGS

Figure 2:
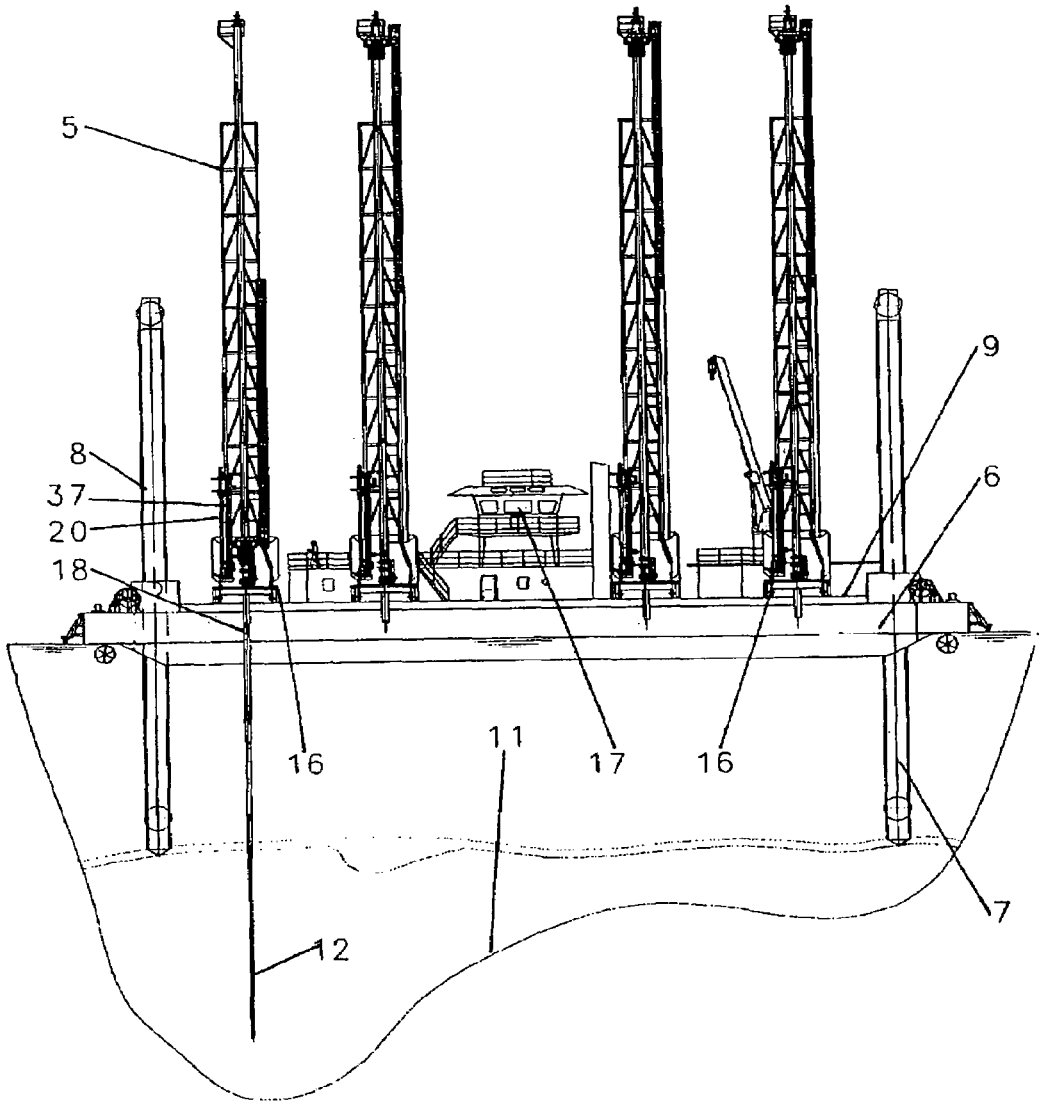
Figure 5:
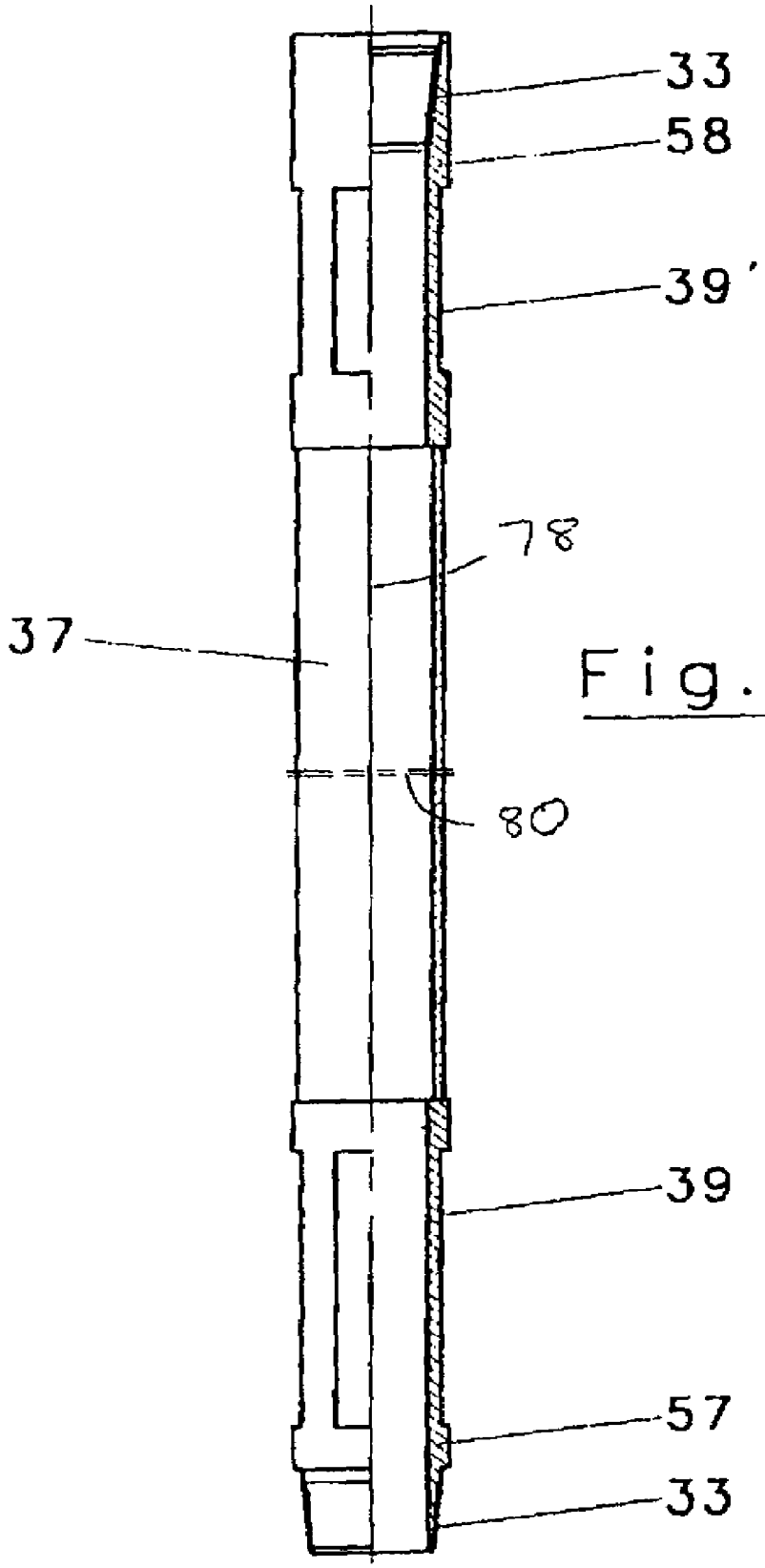
Figure 6:
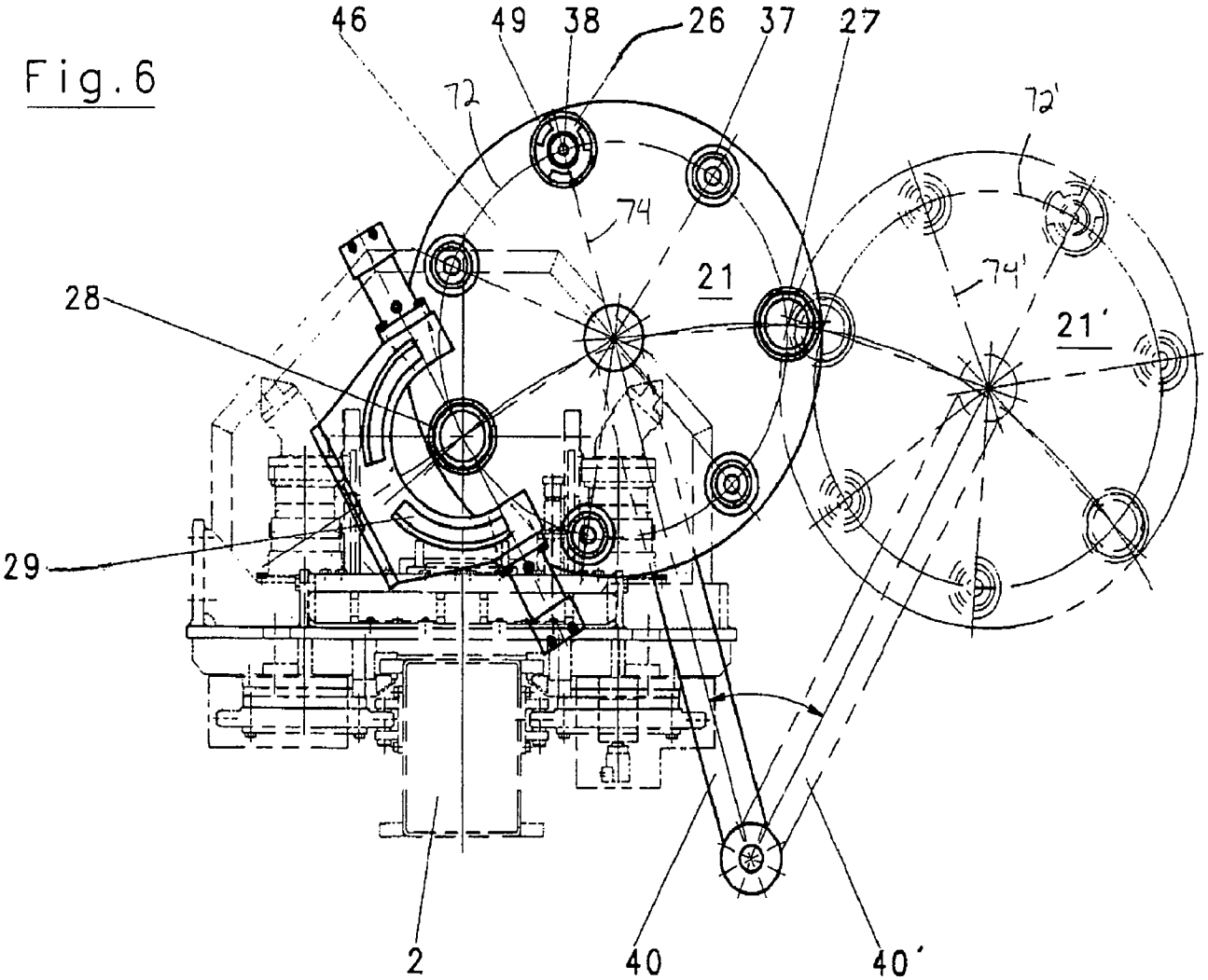
Figure 7:
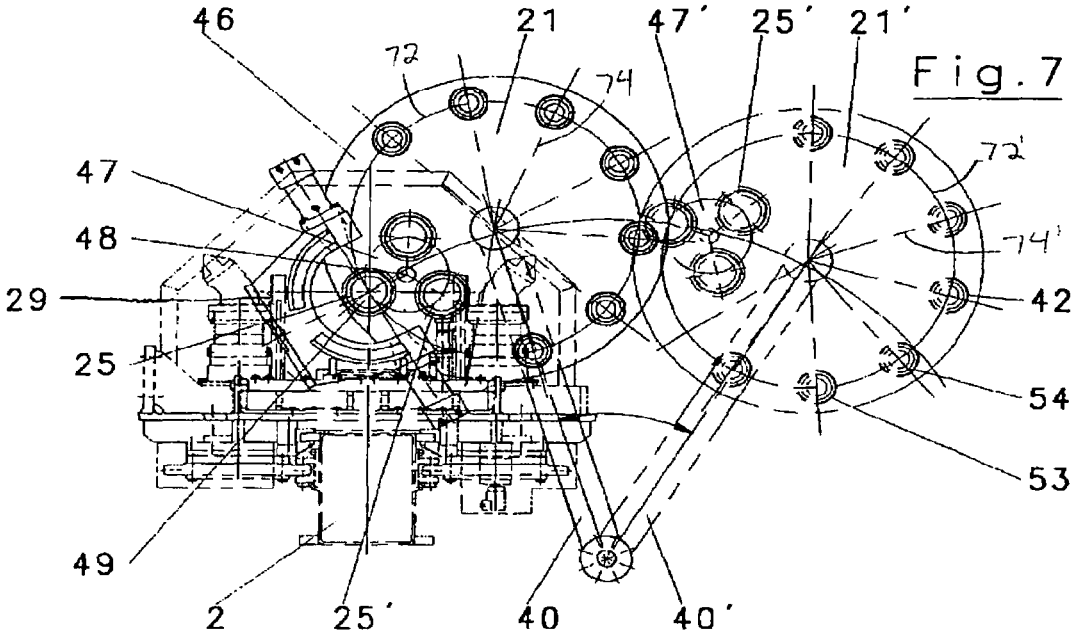
Figure 8:
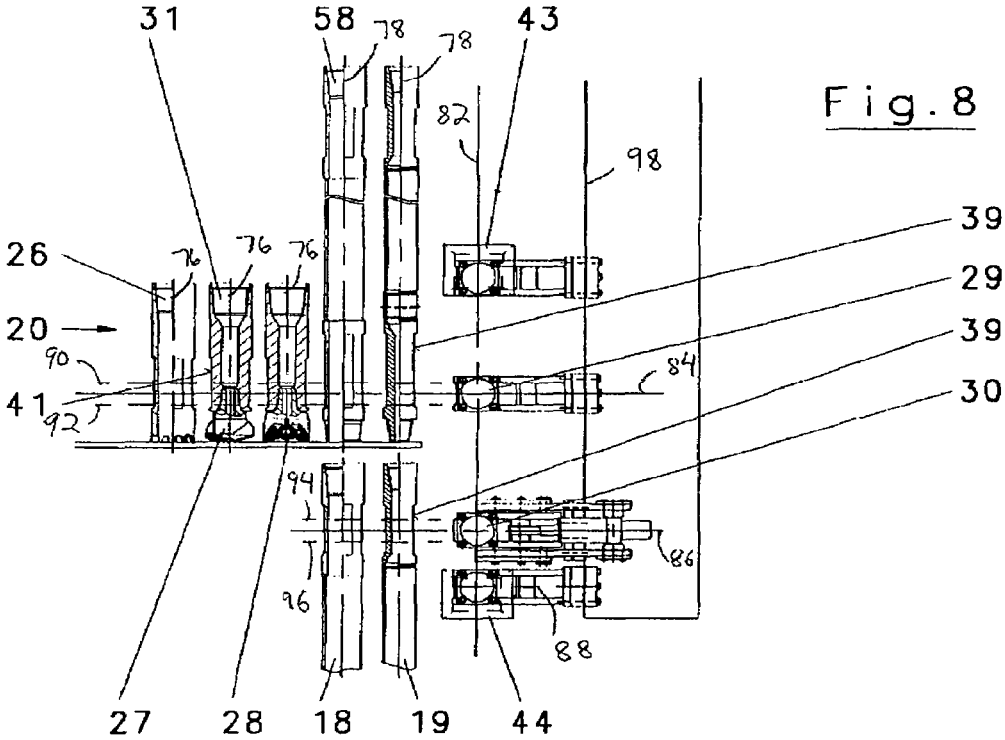
Figure 13:
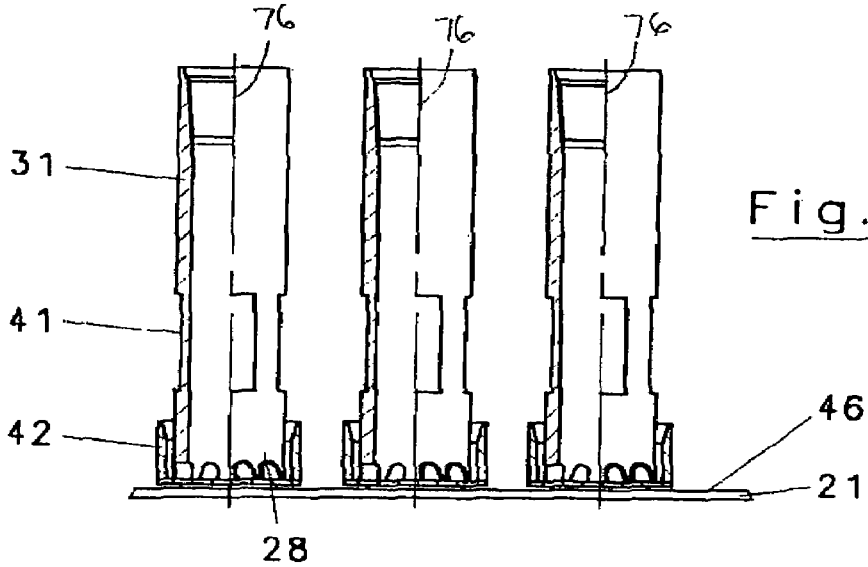
Figure 14:
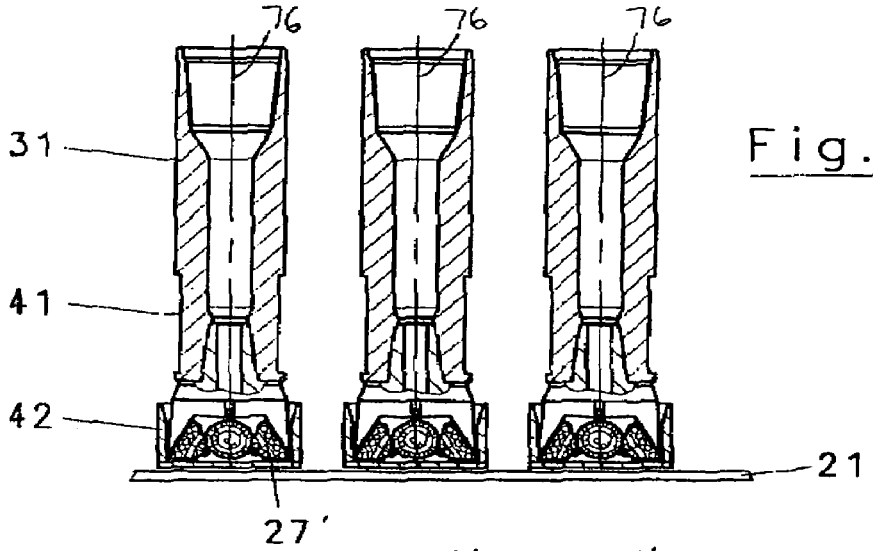
Figure 15:
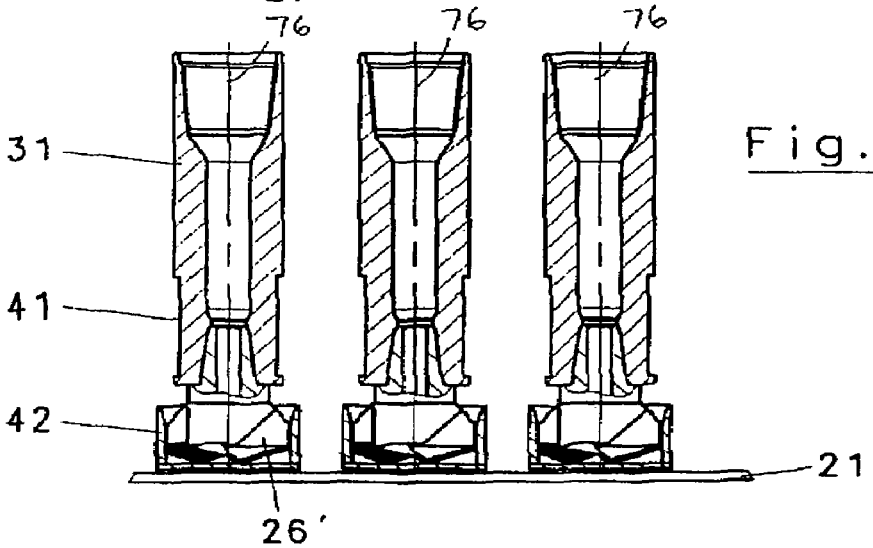

FIG. 1 a drill frame or drill platform, which is arranged on a ship caisson, FIG. 2 such a ship caisson in a side view and with the illustration of different positions of the drill platform or the drill frame, FIG. 3 a rod magazine comprising several platforms for drill rods or drill tools, said magazine being pivoted into the drill axis, FIGS. 4A. 4B, and 4C show three embodiments of drill tools, partially in sectional views, FIG. 5 a drill rod with upper and lower ends, partially in sectional views, FIG. 6 the rod magazine illustrated in FIG. 3 once in the working position, i.e. in the drill axis, and once in the resting position, FIG. 7 another embodiment of the rod magazine with an additional table, FIG. 8 the arrangement on the lower end of the drill frame with the clamping and crushing devices, FIGS. 9A through 9F show several positions during the replacement of a boring bit, FIG. 10 the upper rotary table of the rod magazine with the support edge plate in a bottom view, FIG. 11 the support edge plate in a top view, FIG. 12 the lower part of a rod magazine with a central plate, FIG. 13 the section of a rod magazine with several ring cutters, FIG. 14 the same section with several boring bits, and FIG. 15 the same section with several bits.

DETAILED DESCRIPTION OF THE PREFERRED EMBODIMENTS

FIG. 1 shows a drill frame 1, which is equipped with a carriage 2 and a sliding drill head 3, wherein here the drill instrument 4 with rotating gear 70 is arranged on the upper end of the rig 5. Said drill frame 1 or rig 5 is installed on a ship caisson or stabilizing ship 6, which is arranged on the ground 11 of the body of water by means of several legs 7, 8. Said legs 7, 8 can be retracted according to FIG. 2 so that the entire ship caisson 6 can be easily transferred to a new working position. It may also comprise its own drives.

The drill frame 1 or rig 5 can be brought from one position into another on the deck 9 by means of deck guides 16, as is illustrated in FIG. 2. In this manner several bore holes 12, 13 can be driven into the lake bottom or the bottom 11 of the body of water using one and the same drill frame 1. The water level 10 is indicated, and the floating buoys 15 connected to the respective bore hole 12, 13 by means of fuses 14 are also shown, so that the required connection of the individual bores that are equipped with explosives is possible. Via the control station 17 on the ship caisson 6 all operations can be monitored easily.

In the embodiment shown here the illustrated bore holes 12, 13 are driven into the bottom of the lake 11' initially with a roller bit 27, which will be illustrated later, or also with a bit 26. After having reached the lower position, the drill tool 25 is pulled out of the bore hole 12, 13 via the drill rod arrangement 18. Then the bit 26 or the roller bit 27 is replaced with a ring cutter 28, which now slides the same drill rod arrangement 18 or a separate drill rod arrangement into the bore hole 12, 13. This offers the possibility of flushing in the explosive through said drill rod arrangement 18, with the respective igniter and also the fuse or line 14. These are held on the lower end in the very bottom of the bore hole by their weight and possible deformation such that then the ring cutter 28 can be pulled out of the bore hole with the corresponding drill rod arrangement 18. What remains then is the position in the area of the bore hole 12 denoted with 14 and 15, i.e. the occupied bore hole 12 can be identified from the water surface easily and safely so that after the individual floating buoys 15 or fuses 14 are connected a plurality of blasts can be performed simultaneously.

The above explanations clarify that a replacement of the drill tools 25 is required, which in the state of the art was possible only with the aid of separate auxiliary devices or by hand. FIG. 1 indicates that a rod magazine 20 for accommodating the required drill tools 25 is allocated to the drill rod arrangement 18 or exploratory drill rod arrangement 19 or to the entire rig 5. Said rod magazine 20 with the lower rotary table 21 and the upper rotary table 22 is designed such that it can rotate around the center line 23. The same is illustrated by the figures following later on.

Adding to FIG. 1, FIG. 2 shows that an exploratory bore hole 12' may also be initially driven because the devices required to do so can be kept available without difficulty. 37 denotes replacement bore rods, which in the above-mentioned rod magazine 20 can be kept available.

FIG. 3 shows the afore-mentioned rod magazine 20 in the working position, i.e. one of the platforms 36, 38 has been pivoted in the drill axis 35 in order to fasten a drill tool 25, which is not shown here, to the drill rod arrangement 18 using the shown clamping device 29 or clamping and crushing device 30. Swivel arm 40 is connected to the drill rig 5 by connection 103. In detail in FIG. 3 only replacement drill rods 37, 37', 37" are positioned in the provided holder pots 42. It is just as feasible that the above-mentioned drill tools 25 are arranged here, as FIG. 4 shows. 34 denotes the grippers of the clamping device 29 or clamping and crushing device 30, by means of which the respective drill rod 37 or also the drill tool 25 can be seized and fixed in order to detach or establish the connection.

FIGS. 4A through 4C shows three types of drill tools 25, specifically one ring cutter 28 in FIG. 4A, one bit 26 in FIG. 4B and one roller bit 27 in FIG. 4C. All are equipped with an adapter 31, which comprises at the top a thread 32 in the shape of a female part, which corresponds to the respective thread 33 of the drill rod 37 or drill rod arrangement 18, which will be explained below. In this manner a simple and easy connection is possible. Shown are additionally the gripping surfaces 41, which each drill tool 25 comprises in order to enable secure seizing by the clamping and crushing device 30. Reference lines 76 extend through the longitudinal axis of the drill tools.

FIG. 3 illustrates the swivel arm 40, which enables swiveling of the entire rod magazine 20 from the working position into the resting position. The corresponding illustration is shown in FIG. 6. In FIG. 6, apart from the platforms 36 or holder pots 42 for the replacement drill rods 37, such platforms 38 for drill tools 25 are also provided.

FIG. 5 shows a drill rod 37, which may involve a replacement drill rod 37 or another normal drill rod that is inserted in a drill string. Already the term replacement drill rod shows that here an exchange is possible. These drill rods 37 are also equipped with gripping surfaces 39. It is possible by means of said gripping surfaces 39, 39' to allow the clamping device 29 or the clamping and crushing device 30 to engage in order to establish the drill rod-drill tool connection 50 or the drill rod-drill rod connection 51, or to dissolve it. The upper end of such a drill rod 37 comprising the thread 33 is referred to as the female piece 56 and the lower end as the male piece 57, wherein both have the same thread 33, with which the adapter 31 is also equipped. Reference line 80 runs horizontally through the middle of drill rod 37.

In FIG. 7 a rod magazine 20 is also shown in the working position and in the resting position. Deviating from the illustration in FIG. 6, here one of the platforms 38 is equipped with an additional plate 47. Said additional plate 47 is arranged on the upper side 46 of the lower rotary table 21 such that it can pivot around the axis 48. The holders 49 correspond to the holders on the lower rotary table, i.e. they are equipped with holder pots 42 as well. Arranged therein are either bits 26, roller bits 27 or ring cutters 28, or pursuant to the embodiment shown in FIGS. 13, 14, and 15 only ring cutters 28 or roller bits 27 or bits 26. The advantage of this embodiment is that here only one platform for these drill tools 25 is required so that the remaining platforms all remain available for replacement drill rods 37. These holders have been denoted with 53, 54, wherein this figure also illustrates that the entire rod magazine 20 can pivot from the working position into the resting position or storage position and back. Here the holders 53, 54 have their centers at points around the circumference of reference circle 72. Reference lines 74 extend from the center of the lower rotary table 21 through the centers of the holders 53, 54.

FIG. 8 shows such a rod magazine 20 in a sectional view, wherein here also different rod arrangements in the form of the typical drill rod arrangement 18 or the exploratory drill rod arrangement 19 are shown, which can and/or should be connected to each other, respectively. The connection is established via the afore-mentioned clamping device 29 and clamping and crushing device 30, wherein both are arranged in front of or allocated to a drill rod arrangement guide 43 or 44, which here is used especially as a drill guide with respect to the drill rod arrangement guide 44. Reference lines 78 extend through the longitudinal axis of drill rod arrangements 18, 19. Orthogonal reference line 82 extends through the drill guides 43, 44 and clamping device 29 and clamping and crushing device 30. Reference lines 84, 86 extend horizontally through the center of the clamping device 29 and clamping and crushing device 30, respectively, showing their height with respect to the items on the rotary table and the drill rod arrangements 18, 19. Reference line 88 runs horizontally through the center of the drill guide 44. Reference lines 90, 92, and 94, 96 run horizontally through the top and bottom of the clamping device and clamping and crushing device 29, 30 respectively, showing where the items on the rotary table and drill rod arrangements are gripped. The guides 43, 44 and clamping and clamping and crushing devices 29, 30 are supported by element 98.

Figures 9A, 9B, 9C, 9D, 9E, 9F:
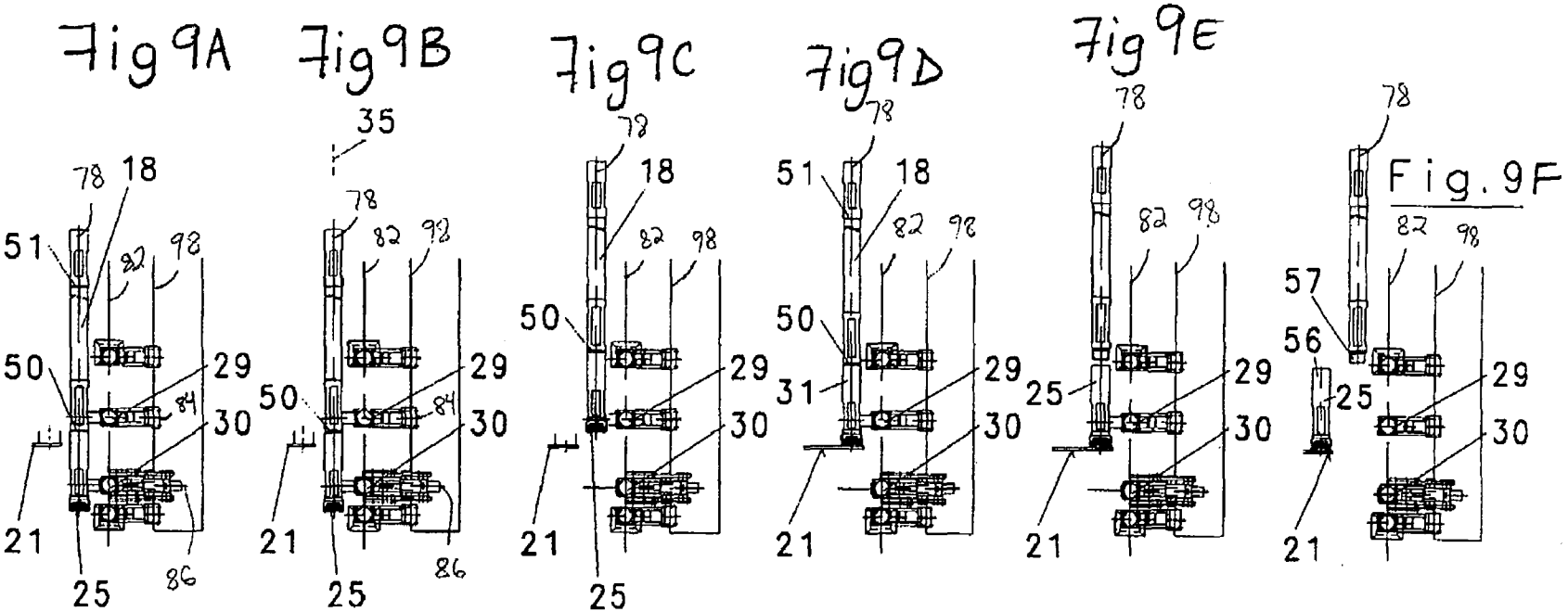

FIGS. 9A through 9F shows the operating cycle for the replacement of the drill tool 25, here in the form of a roller bit 27. First, as shown in FIG. 9A, the drill rod arrangement 18 is pulled out of the bore hole, wherein the drill rod-drill rod connection 51 and the drill rod-drill tool connection 50 are closed. Upon insertion and fixation in the clamping and crushing device 29, 30, in the second illustration shown in FIG. 9B the drill rod-drill tool connection 50 has been interrupted. The drill rod arrangement 18 is then lifted, as shown in FIG. 9C, with the detached drill rod-drill tool connection 50, in particular to the height of the lower rotary table 21, which is now pivoted into the drill axis 35 so that the roller bit 27 can be placed thereon. Then, as shown in FIG. 9D, the roller bit 27 or its adapter 31 is seized with the clamping device 29, and the drill rod arrangement 18 is rotated away by means of the rotating drive of the drill instrument. The position is reflected in the second to the last illustration in FIG. 9E on the right. The last illustration, FIG. 9F, shows how the configuration swivels apart, i.e. the rotary table 21 is swiveled out of the drill axis so that now another drill tool 25 can be connected to the drill rod arrangement 18. The female and male parts are denoted here as 56 and 57. In FIG. 8 additionally the female part of the drill rod arrangement 18 has been denoted with its own reference number, namely 58, in order to illustrate that the drill rods by nature comprise a female piece 58 on the end opposite the male piece 57.

FIGS. 10 and 11 show the upper rotary plate 22 once in a view into the rotary table, i.e. from below, and once from above. It is clarified that the actual base plate 63 of the upper rotary table 22 is equipped with clamps 60, 61 in order to be able to fix the upper ends of the replacement drill rods 37. Said base plate 63 pivots together with the entire rod magazine 20, while the likewise illustrated support edge plate 64 remains fixed with its downward pointing support edge 65. Said support edge 65 therefore prevents the replacement drill rods 37 from falling out, however it can be opened if specific removal of the replacement drill rods 37 is necessary. For this a lateral recess 66 is provided in the support edge 65, which in the stored state of the rod magazine 20 is closed by means of a segmental slide 67. Said segmental slide 67 is indirectly connected via a swivel axis holder 69 to the center axis 23 by means of a fly lever 68 so that during pivoting or rotation of the rod magazine 20 the segmental slide 67 is displaced along with it at the same time, thus opening the lateral recess 66. The rounded parts of clamps 60, 61 have their centers at points around the circumference of reference circle 100. Reference line 102 runs through the middle of swivel arm 40 and reference line 104 is perpendicular to this line.

FIG. 12 shows a center plate 62, which serves as the upper fixation for the respective drill tools 25, and is hence also equipped with corresponding clamps 60', 61'. Said center plate 62 also makes it possible to operate with a very short design of a rod magazine 20, namely when the replacement drill rods 37 can be eliminated. These are indicated here, and it is also illustrated that the provided clamps 61' can be involved and used for intermediate fixation and/or for optimal fastening and fixation of the replacement drill rods 37 in the rod magazine 20.

The pot- or pin-shaped holders 42, 53, 54 for the tools 25 and the replacement drill rods 37 are allocated to the lower rotary table 21, wherein their fixation on the top 46 is illustrated here.

A design of a rod magazine comprising only replacement drill tools 25 is reflected in FIGS. 13, 14, 15; further details in this respect have already been explained further above.

All afore-mentioned features, including those revealed only in the drawings, are considered essential for the invention alone and in combination with one another.

The invention claimed is:

1. Drill frame for driving bores for different or changing functions comprising a rig (5) that accommodates a carriage (2) for a sliding drill head (3), a drill instrument (4) arranged thereon with a rotating gear and with a drill tool (25) detachably connected to the drill instrument (4), and with a clamping and crushing device (30) for a drill rod arrangement (18) that connects between the drill instrument and the drill tool, characterized in that the drill instrument is equipped with an attachment or adapter (31), which comprises a thread (32) that corresponds to a second thread (33) of the drill rod arrangement (18) and is designed such that it can be seized by the clamping and crushing device (30), and in that the rig (5) is allocated a rod magazine (20) that is pivotable into a drill's longitudinal axis (35) and comprises platforms (38) for pivoting individual drill rods/drill tools (37, 25), wherein the rod magazine (20) is open on the side of any of said drill tools thereon such that the drill tool thereon can be inserted into the clamping and crushing device (30) without moving the clamping and crushing device (30) in the direction of the drill's longitudinal axis, wherein the drill rod magazine (20) can rotate around a central axis (23) and comprises a lower rotary table (21) that comprises the platforms (36, 38), one or more of which is a holder (42, 53, 54) for the drill tools (25) and/or for replacement drill rods (37).

2. Drill frame pursuant to claim 1, characterized in that the rig (5) is designed such that it accommodates and guides the drill rod arrangement (18) comprising several drill rods (37, 37') that are connected to one another.

3. Drill frame pursuant to claim 1, characterized in that the drill rod magazine (20) is arranged pivotably on the rig (5) by means of a swivel arm (40) at the height of the clamping and crushing device (30).

4. Drill frame pursuant to claim 1, further comprising elastic clamps (60, 61) for the drill rods (37) connected to an upper rotary table of the rod magazine.

5. Drill frame pursuant to claim 4, characterized in that the clamps (60, 61) for the drill rods (37) are allocated to a center plate (62) arranged on a center axis (23) above holders (49).

6. Drill frame pursuant to claim 5, characterized in that the clamps (60, 61) are adjustable, connected accordingly to a base plate (63) of an upper rotary table (22) or the center plate (62).

7. Drill frame pursuant to claim 1, characterized in that the drill tools (25) and/or their adapters (31) are equipped with gripping surfaces (41) for grippers (34) of the clamping and crushing device (30).

8. Drill frame pursuant to claim 1, characterized in that gripping surfaces (41, 39) on the adapter (31) and on the drill rods (37) are designed on the adapter (31) and on the respective drill rods (37) so that given the distance between a clamping device (29) and the clamping and crushing device (30), both the adapter and the drill rod can be gripped and seized.

9. Drill frame pursuant to claim 1, characterized in that the clamping and crushing device (30) is allocated hydraulic drill rod guides (43, 44), serving as drill guides.

10. Drill frame pursuant to claim 1, characterized in that the holders (42, 54, 53) for the drill tools (25) and also for the replacement drill rods (37) are designed to be pot-shaped or pin-shaped and are placed onto a top (46) of the lower rotary table (21).

11. Drill frame pursuant to claim 1, characterized in that the lower rotary table (21) comprises one or more additional plate (47) that accommodates the drill tools (25) and the one or more additional plate (47) is pivotable separately from the rotary table (21), to which the holders (54) for the bit, roller bit ring cutter (26, 27, 28), or other drill tool (25) are allocated, wherein the actual rotary table (21) comprises additional holders (53) for the replacement drill rods (37).

12. Drill frame pursuant to claim 1, characterized in that the torque in a direction of detachment of the rotating gear of the drill instrument (4) is adjusted such that the torque is just sufficient to unscrew an already interrupted drill rod-drill tool connection (50).

13. Drill frame pursuant to claim 1, characterized in that the rig (5) is allocated to a ship caisson (6) or a stabilizing ship and comprises deck guides (16), which enable a position change in several directions.

14. Drill frame pursuant to claim 1, characterized in that the drill tools (25) together with their corresponding adapters (31) are designed such that they always each have the same length.

15. Drill frame pursuant to claim 1, characterized in that an upper rotary table (22) comprises a support edge plate (64) with a support edge (65) that extends in a direction of the lower rotary table (21).

16. Drill frame pursuant to claim 15, characterized in that the support edge plate (64) is stationary and comprises a lateral recess (66) in the support edge (65), which can be closed in a stored state of the rod magazine (20) by means of a segmental slide (67), wherein the segmental slide (67) can pivot together with the rod magazine (20) by means of a fly lever (68).

17. Drill frame pursuant to claim 1, characterized in that the rod magazine (20) has a rectangular design, wherein the entire rod magazine (20) or the individual drill tools (25) or drill rods (37) can pivot into the drill axis (35) using grippers.

18. Drill frame pursuant to claim 1, characterized in that the rod magazine (20) is designed to accommodate only the drill tool (25) and for this purpose consists of the lower rotary table (21) and a center plate (62) and a structure running through the center axis (23) that connects them.

19. Drill frame pursuant to claim 1, characterized in that the rod magazine (20) is designed to accommodate an element selected from a group consisting of only replacement roller bits (27') only replacement bits (26'), only replacement ring cutters (28'), and holds an allocated adapter (31).

20. The drill frame of claim 1, wherein the drill instrument (4) is selected from the group consisting of a bit (26), a roller bit (27), a ring cutter (28), and combinations thereof.

21. The drill frame of claim 1, wherein the drill instrument is selected from the group consisting of a bit (26), 3-winged cutter, roller bit (27), the ring cutter (28), other drill tool (25), and combinations thereof.

* * * * *

UNITED STATES PATENT AND TRADEMARK OFFICE

CERTIFICATE OF CORRECTION

PATENT NO. : 7,631,704 B2
APPLICATION NO. : 11/353278
DATED : December 15, 2009
INVENTOR(S) : Hagemeyer et al.

It is certified that error appears in the above-identified patent and that said Letters Patent is hereby corrected as shown below:

Title page

Item (73) Assignee, should read:

--Klemm Bohrtechnik Zweigniederlassung der Bauer Maschinen GmbH--

Signed and Sealed this

Second Day of February, 2010

David J. Kappos

David J. Kappos
*Director of the United States Patent and Trademark Office*